United States Patent [19]

Heinen et al.

[11] Patent Number: 4,521,945

[45] Date of Patent: Jun. 11, 1985

[54] YARN BULKING JET

[75] Inventors: Peter Heinen; Peter Gossens, both of Heinsberg-Oberbruch, Fed. Rep. of Germany

[73] Assignee: Akzona Incorporated, Asheville, N.C.

[21] Appl. No.: 310,188

[22] Filed: Oct. 9, 1981

Related U.S. Application Data

[63] Continuation of Ser. No. 106,591, Dec. 26, 1979, abandoned.

[30] Foreign Application Priority Data

Dec. 27, 1978 [DE] Fed. Rep. of Germany ..... 2856291

[51] Int. Cl.[3] ..... D02G 1/16

[52] U.S. Cl. ..... 28/273

[58] Field of Search ..... 28/254, 255, 271, 273, 28/275

[56] References Cited

U.S. PATENT DOCUMENTS

| | | | |
|---|---|---|---|
| 3,453,709 | 7/1969 | Dyer | 28/254 X |
| 3,638,291 | 2/1972 | Yngve | 28/273 |
| 3,852,857 | 12/1974 | Ethridge et al. | 28/255 |
| 3,854,177 | 12/1974 | Breen et al. | 28/273 X |
| 3,982,310 | 9/1976 | Beck et al. | 28/255 |

FOREIGN PATENT DOCUMENTS

| | | | |
|---|---|---|---|
| 71986 | 10/1959 | France | 28/273 |
| 842742 | 7/1960 | United Kingdom | 28/271 |

*Primary Examiner*—Robert R. Mackey

*Attorney, Agent, or Firm*—Tom R. Vestal; Francis W. Young

[57] ABSTRACT

A bulking device for making loop yarn, comprising a base with a blowing chamber, a pin insert with a yarn feeding channel and a jet insert with a yarn delivery channel, followed by a diffusor having resonance chamber just behind the inlet cross section from the yarn delivery channel.

5 Claims, 1 Drawing Figure

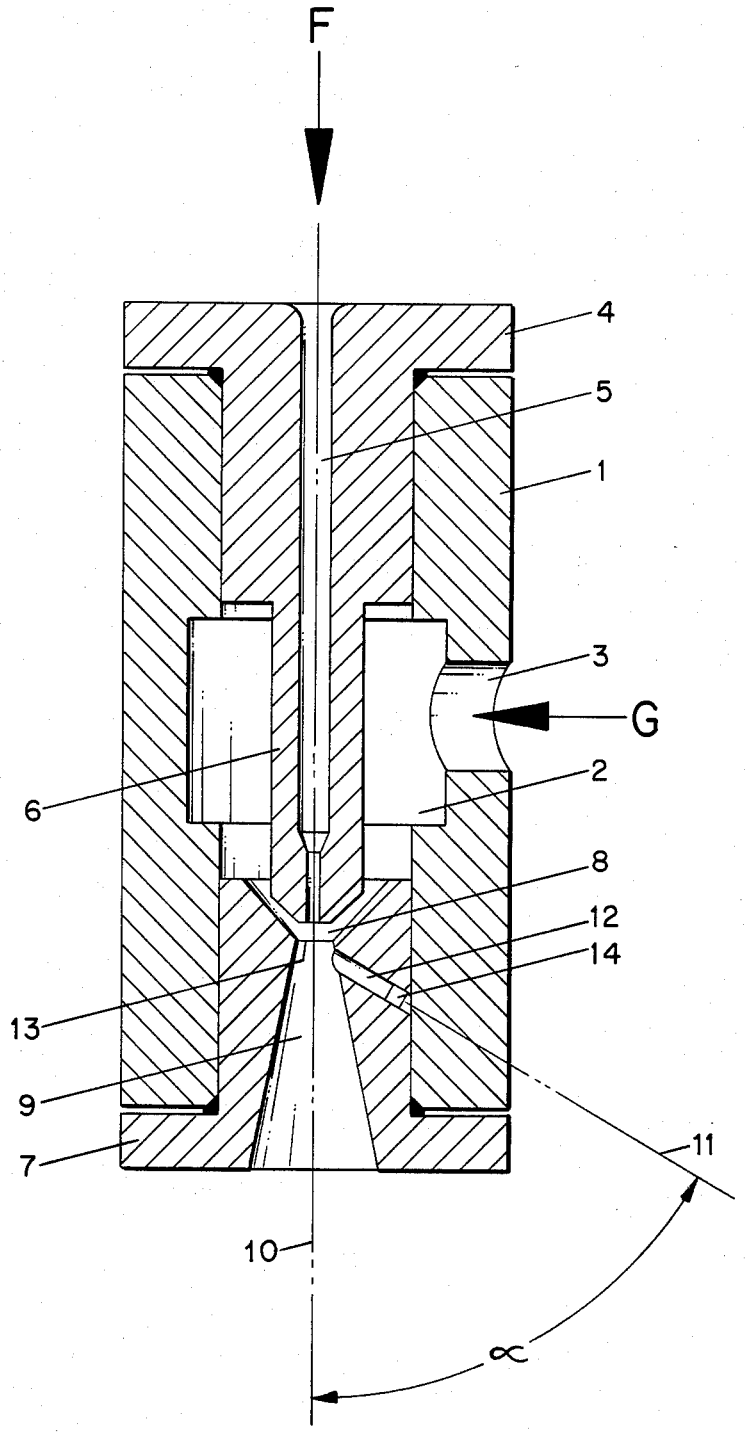
F
4
5
1
3
G
2
6
8
12
14
13
9
7
11
10
∝

YARN BULKING JET

This is a continuation of application Ser. No. 106,591, filed Dec. 26, 1979, now abandoned.

The invention relates to a bulking device for the production of loop yarn consisting of a base forming a blowing chamber with a connection for blowing medium, a pin insert with a yarn feed channel aligned coaxially with the bulking device, the pin insert having a conically pointed pin, and a jet insert with yarn delivery channel extending from the opposite side into the blowing chamber, said jet insert having a conical taper on the inlet side, followed by a diffusor connected to the smallest cross section of the jet insert, whereby the conically pointed pin extends into the conical taper of the jet insert.

A bulking device of this type is described in U.S. Pat. No. 3,577,614. To improve the texturing effect of the bulking device, it is suggested therein to increase the asymmetry of the gas flow either by eccentric alignment of the conical tip of the pin or of the yarn feed channel with respect to the jet axis, and under certain conditions to have also an eccentric alignment of the yarn delivery channel, cf. FIG. 2 of the cited patent.

It has been found that bulking devices of this type consume a relatively large amount of air. Moreover, they permit only a relatively low overfeed, limiting the loop formation effect.

The objective of the invention is to provide a bulking device, making possible a high yarn overfeed combined with a low air consumption.

This objective has been met with a bulking device of the above described type, whereby a resonance chamber closed at its outer end leads into the diffusor directly behind the inlet cross section of said diffusor.

"Closed at its outer end" implies that said resonance chamber is only open at the end facing the diffusor.

The angle $\alpha$ ("alpha") assumed by the resonance chamber with respect to the jet axis may vary within wide limits and is restricted only by the geometry of the yarn delivery channel and particularly by the dimension of the diffusor angle and by the dimension of the cone angle of the conical taper. As a rule, it is between 30° and 120°.

Between the conical taper located on the input side and the diffusor, the yarn delivery channel may have an essentially cylindrical segment. But, preferably, the diffusor is connected directly to the conical taper.

When, according to the invention, a chamber closed at its outer end opens "shortly behind the inlet cross section of the diffusor", this is intended to mean that—depending on the size of the angle "alpha"—the point of intersection of the resonance chamber axis with the jet axis should not be farther than about 20 mm from the inlet cross section of the diffusor. Preferably, this distance should not exceed about 10 mm. whereby the opening cross section of the resonance chamber should be as close as possible to the inlet cross section of the diffusor.

As a result of the resonance chamber provided according to the invention in the diffusor, a sharp increase in the eccentricity of the flow conditions is obtained, which translates into a distinct improvement of the efficiency. This leads to a higher overfeed, hence more pronounced loop formation combined with reduced air consumption.

For further improvement of the efficiency, it is possible to give an eccentric alignment to the bulking pin or to the yarn feed channel provided therein and/or the funnel-shaped taper of the yarn delivery channel with respect to the jet axis, or to include other measures known in prior art aiming at creating asymmetrical flow conditions—perhaps a pin ground on one side.

The invention herein is further described by reference to the attached drawing. The bulking device of the invention consists of an otherwise known base 1 with blowing chamber 2 and opening 3 for the blowing medium (e.g., compressed air) arriving from the direction of arrow G, a pin insert 4, conically pointed pin 6 on the feed side in device base 1, and a yarn feed channel 5 for the filament yarn arriving from the direction of arrow F, as well as of a jet insert 7, inserted from the opposite end into bulking device base 1, which jet insert has a yarn delivery channel with on the input side a conical taper 8 and—preferably directly—connected thereto a diffusor 9. According to the invention, right behind inlet cross section 13 of diffusor 9, there opens a resonance chamber 12, which by lateral drilling into jet insert 7 and by closure 14 at its outer end is provided with an end closure. The diameter of the resonance chamber 12 measures as a rule less than 2 mm for a yarn delivery channel of conventional dimensions. The angle "alpha" between the resonance chamber axis 11 and the jet axis 10 is preferably between 45° and 90°, so that the resonance chamber is facing into the emerging blowing medium. Especially good results can be obtained when the angle "alpha" is smaller than 90°. In the favored range of 45° to b 90°, the best results are obtained within the range of 60° to 70°.

EXAMPLE I

With a bulking device as illustrated in the drawing (alpha=65°, resonance chamber dia.=0.9 mm), a dtex 340 f 72 polyethylene terephthalate filament bundle can be processed to outstanding looped yarn at texturing speeds of 120 to 180 mpm, and compressed air of 10 bar at a rate of 8.4 $Nm^3/hr$, and 30% overfeed. The maximum feasible overfeed at e.g., 8 bar and 150 $Nm^3/hr$ is 70%, air consumption being thereby 6.6 $Nm^3/hr$.

If, on the other hand, use is made of the bulking device illustrated in FIG. 1 of U.S. Pat. No. 3,577,614, a pressure of 8 bar combined with an air consumption of 7.6 $Nm^3/hr$ will only provide a maximum possible overfeed of 67%.

EXAMPLE II

When use is made of the bulking device according to FIG. 2 of U.S. Pat. No. 3,577,614 (with ground pin), the air consumption increases to 13.3 $Nm^3/hr$ and the maximum overfeed is 81%.

EXAMPLE III

By providing the bulking device of the invention as illustrated with a ground pin (as FIG. 2 of U.S. Pat. No. 3,577,614), the consumption of air drops to 5.8 $Nm^3/hr$ with an increase of the maximum feasible overfeed to 173%.

We claim:

1. Bulking device for the production of loop yarn comprising a base forming a blowing chamber with a connection for blowing medium, a pin insert with a yarn feed channel aligned coaxially to the bulking device axis extending into the blowing chamber, the pin insert having a conically pointed tip, a jet insert with a yarn delivery channel extending from the opposite end into the blowing chamber, with a conical taper on the inlet side relative to said conical tip, a diffusor being connected to the smallest cross section thereof, whereby the conically pointed bulking pin extends into the conical taper of the jet insert, further comprising a resonance chamber (12), closed at its outer end, leads into diffusor (9) just behind the inlet cross section of the latter (13).

2. Bulking device according to claim 1, wherein the axis of the resonance chamber (11) forms with the axis of the jet (10) an angle $\alpha$ (alpha) between 30° and 120°.

3. Bulking device according to claim 2, characterized in that the angle (alpha) is between 45° and 90°, preferably between 60° and 70°.

4. Bulking device according to claim 1, 2 or 3, wherein diffusor (9) connects directly to the conical taper (8) of the yarn delivery channel.

5. Bulking device according to claim 4, wherein the point of intersection of resonance chamber (11) with the jet axis (10) is not more than 10 mm away from the inlet cross section (13) of diffusor (9).

* * * * *